United States Patent [19]

Keane

[11] Patent Number: 4,550,957

[45] Date of Patent: Nov. 5, 1985

[54] ELECTRICAL HOSE SWIVEL CONNECTOR FOR CANISTER VACUUM CLEANER

[75] Inventor: James W. Keane, White Bear Lake, Minn.

[73] Assignee: Whirlpool Corporation, Benton Harbor, Mich.

[21] Appl. No.: 651,101

[22] Filed: Sep. 17, 1984

[51] Int. Cl.[4] ..... H01R 39/00

[52] U.S. Cl. ..... 339/5 R; 339/16 R

[58] Field of Search ..... 339/5, 6, 8, 15, 16

[56] References Cited

U.S. PATENT DOCUMENTS

| | | | |
|---|---|---|---|
| 3,407,373 | 10/1968 | Brown et al. | 339/5 |
| 3,470,521 | 9/1969 | Downey | 339/8 |
| 3,546,656 | 12/1970 | Pritulsky | 335/16 |
| 3,553,629 | 1/1971 | Brown et al. | 339/15 |
| 4,003,616 | 1/1977 | Springer | 339/8 R |
| 4,012,091 | 3/1977 | Westergren | 339/15 |
| 4,063,790 | 12/1977 | Kleykamp et al. | 339/16 R |
| 4,094,535 | 6/1978 | Minton | 285/7 |
| 4,117,287 | 9/1978 | Walker et al. | 339/16 R |
| 4,143,930 | 3/1979 | Schauer | 339/6 R |
| 4,162,370 | 7/1979 | Dunn et al. | 174/47 |
| 4,188,081 | 2/1980 | Holden et al. | 339/15 |
| 4,283,594 | 8/1981 | Somers | 174/47 |
| 4,345,805 | 8/1982 | Finley et al. | 339/16 R |

*Primary Examiner*—Joseph H. McGlynn

*Attorney, Agent, or Firm*—Wood, Dalton, Phillips Mason & Rowe

[57] ABSTRACT

An improved swivel connector for use in connecting one end of a flexible vacuum cleaner hose to the suction inlet of the canister portion of a canister vacuum cleaner. The hose is provided with electrical conductors and the swivel connector is mounted on the end of the hose and arranged to effect an automatic connection and disconnection of the electrical conductors of the hose to a power source in the canister as an incident of connection and disconnection, respectively, of the suction hose end to the suction inlet of the canister. The swivel connector includes a pigtail for effecting the connection between the relatively swivelable parts of the connector. Stops are provided for limiting the amount of swiveling permitted so as to prevent strain from being applied to the pigtail ends, while providing substantial permitted angle of swiveling, as desired.

20 Claims, 9 Drawing Figures

FIG. 1
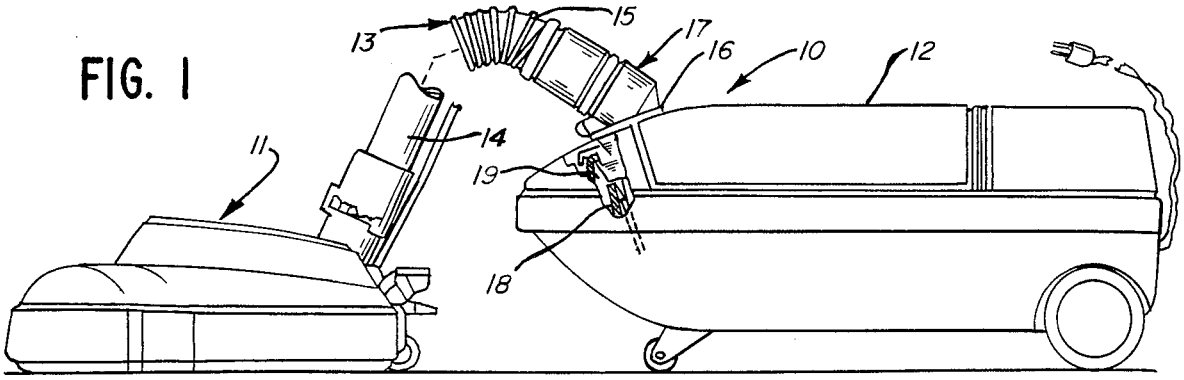
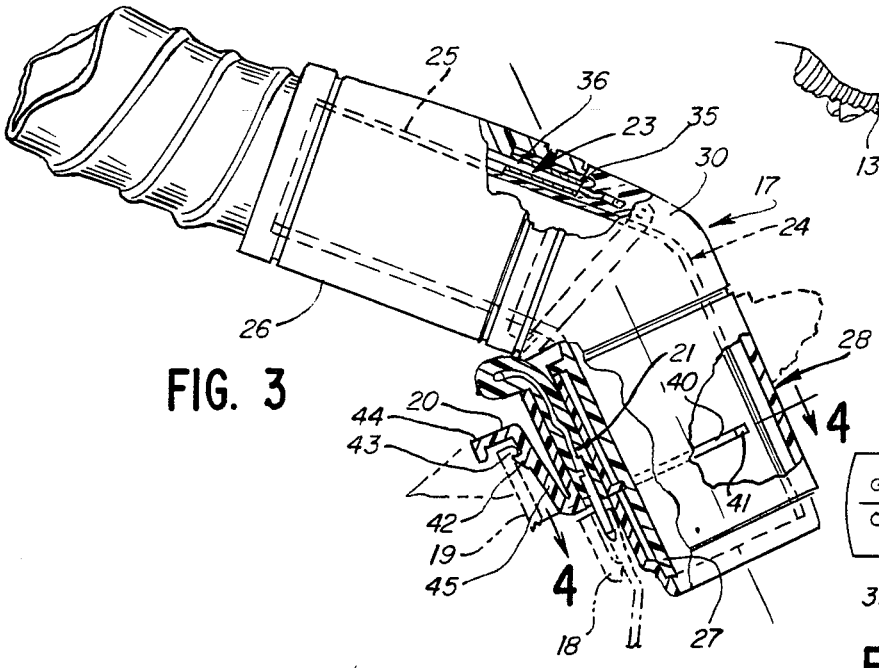
FIG. 3
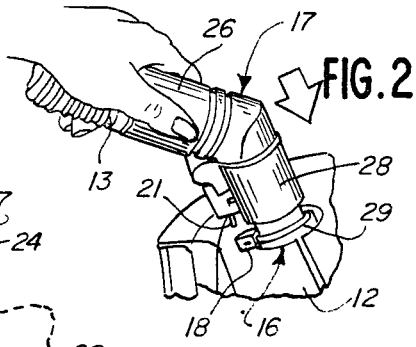
FIG. 2
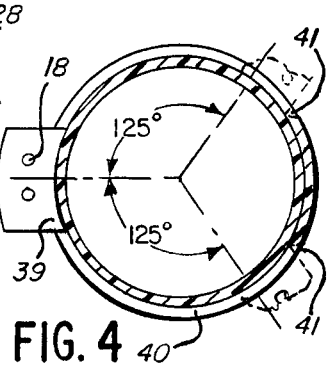
FIG. 4
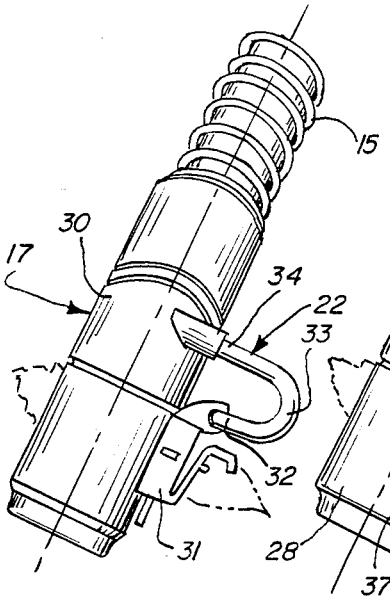
FIG. 6
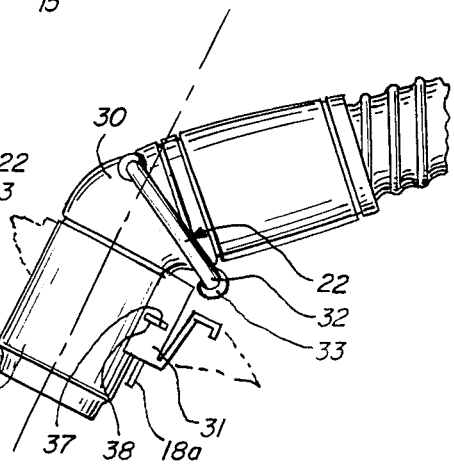
FIG. 5
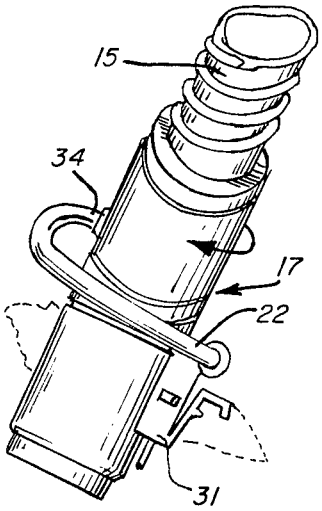
FIG. 7

ELECTRICAL HOSE SWIVEL CONNECTOR FOR CANISTER VACUUM CLEANER

BACKGROUND OF THE INVENTION

1. Field of the Invention

This invention relates to vacuum cleaners and in particular to a swivel connector for connecting one end of a suction hose to a vacuum cleaner canister.

2. Description of the Background Art

In one form of vacuum cleaner, the suction fan and filter bag are mounted in a wheeled canister. A dirt pickup nozzle is connected to the canister through a hollow wand and flexible suction hose.

In one form of nozzle, a power driven brush is provided for improved beating of the subjacent carpet in removing dirt therefrom in the vacuum cleaning operation. It is necessary to provide electrical power to the motor driving the brush and, thus, it is further necessary to provide an electrical connection between the electrical conducting means carried by the hose and the electric power source means associated with the canister.

It is further desirable in such vacuum cleaners to permit swiveling of the end of the hose connected to the canister for facilitated manipulation of the nozzle in the floor cleaning operation. It is conventional to provide a hose connector which is removably inserted into a suction inlet portion of the canister. Thus, it is further necessary to provide some means for maintaining the electrical connection between the electrical conducting means of the hose and the power source means of the canister, while permitting the swiveling movement of the hose connector relative to the canister suction inlet.

One example of a canister-type vacuum cleaner having a current-carrying hose is disclosed in U.S. Pat. No. 4,012,091 of George A. Westergren, which patent is owned by the assignee hereof. As shown in the Westergren patent, the electrical terminal means of the hose comprise a terminal adapter removably connected to the hose end to have electrical connection with contacts provided within the hose and attached to the hose wires. As further illustrated in the Westergren patent, a retaining means is defined by a housing extending about the adapter terminals forming an electrical receptacle for connection thereto of a conventional electrical connector. The terminal adapter is replaceable in the hose construction for facilitated maintenance.

M. John Somers discloses, in U.S. Pat. No. 4,283,594, a canister vacuum cleaner wherein the electrical conductors of the hose are connected to a power source means carried by the canister through a cable having male and female plugs respectively at opposite ends. In connecting the hose to the suction means of the canister, one end of the hose is connected to a suction inlet. The electrical connection is made in a separate operation.

A similar arrangement is disclosed in U.S. Pat. No. 4,063,790 of Donald L. Kleykamp et al.

SUMMARY OF THE INVENTION

The present invention comprehends an improved swivel-type connector for use with a canister vacuum cleaner hose wherein the hose suction connection and wiring connection are automatically jointly made as an incident of the user inserting the end of the hose into a suction inlet of the canister of the vacuum cleaner.

The invention comprehends the provision of latch means for automatically releasably retaining the hose end in connected association with the suction inlet.

The invention further comprehends the arrangement of the latch means for automatic release as an incident of the user grasping the suction hose end in removing it from association with the suction inlet, when desired.

In the disclosed arrangement, the electrical connection is effected by means of a pigtail having one end electrically connected to the power supply carried by the vacuum cleaner canister as an incident of the connection of the suction hose to the suction inlet.

The length of the pigtail is preselected to permit a preselected amount of swiveling.

Stop means may be provided in the swivel connector so as to limit the swivel connection and thereby prevent strain of the electrical connector pigtail under maximum permitted swiveling conditions.

More specifically, the invention comprehends the provision in a vacuum cleaner having a canister housing defining a suction inlet and an electrical power connector adjacent the opening, and a hose for conducting dirt-laden air to the suction inlet and provided with electrical power conducting means, of an improved swivel connector having a first portion secured to the hose end, and a second portion adapted to be removably secured to the housing in the suction inlet, the first portion being swivelly connected to the second portion, an electrical power plug removably mounted to the swivel connector second portion, first cooperating interlock means on the plug and swivel connector second portion for releasably locking the plug to the swivel connector second portion, second cooperating interlock means on the plug and swivel connector first portion for preventing axial separation of the first and second swivel connector portions, and cooperating electrical connection means on the plug and the swivel connector first portion for electrically connecting the electrical power connector to the electrical power conducting means with the swivel connector first and second portions in any one of a plurality of different angularly related swivel positions.

The invention further comprehends the provision in a vacuum cleaner structure having a suction hose and a canister defining a suction inlet arranged for connection thereof to one end of the hose to provide a swivelable suction connection therebetween, electrical power source means on the canister, and electrical power conducting means on the hose, of an improved electrically conductive means for electrically connecting the electrical power conducting means on the hose to the electrical power conducting means on the canister as an incident of connection of the hose end to the suction inlet, the electrically conductive means comprising a flexible pigtail permitting reciprocable swiveling of the hose end relative to the canister up to a preselected maximum amount from a center disposition.

The invention still further comprehends the provision in a vacuum cleaner structure having a suction hose and a canister defining a suction inlet arranged for connection thereof to one end of the hose to provide a swivelable suction connection therebetween, electrical power source means on the canister, and electrical power conducting means on the hose, of cooperating interlock means associated with the hose end and canister respectively for releasably locking the hose end to the suction inlet, and interlock means being disposed to be disengaged as an incident of manual urging of the tube end from the suction inlet.

The improved swivel connector of the present invention is extremely simple and economical of construction while yet providing improved facilitated connection and disconnection of the hose end to the canister, with both the suction connection and electrical connection being automatically effected concurrently by the insertion and removal of the hose end relative to the canister suction inlet.

BRIEF DESCRIPTION OF THE DRAWING

Other features and advantages of the invention will be apparent from the following description taken in connection with the accompanying drawing wherein:

FIG. 1 is a fragmentary side elevation of a canister-type vacuum cleaner having an improved swivel connector embodying the invention;

FIG. 2 is a fragmentary perspective view illustrating the facilitated connection of the hose end to the canister permitted by the structure of the invention;

FIG. 3 is a fragmentary side elevation with portions broken away for providing improved illustration of the invention;

FIG. 4 is a transverse section taken substantially along the line 4—4 of FIG. 3 further illustrating the stop means of the invention;

FIG. 5 is a fragmentary side elevation looking from the reverse side of FIG. 3;

FIG. 6 is a fragmentary side elevation similar to that of FIG. 5 but showing the hose end swiveled approximately 90° into the plane of the paper from the position of FIG. 5;

FIG. 7 is a fragmentary side elevation similar to that of FIG. 5, but showing the hose end swiveled approximately 90° from the plane of the paper from the position shown in FIG. 5.

DESCRIPTION OF THE PREFERRED EMBODIMENT

Figure 8:
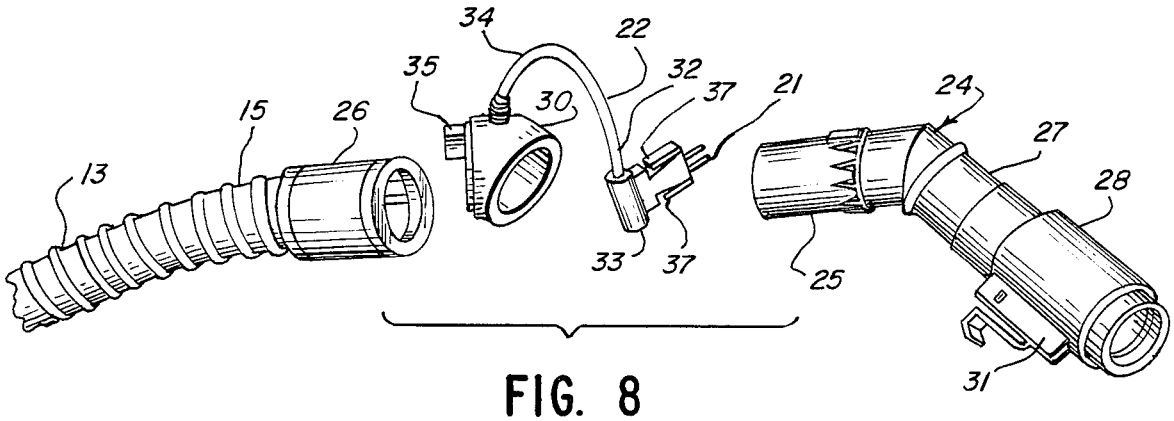
FIG. 8 is an exploded perspective side elevation view illustrating the elements of the improved swivel connector embodying the present invention.

In the illustrative embodiment of the invention as disclosed in the drawing, a vacuum cleaner generally designated 10 is shown to comprise a canister-type vacuum cleaner having a wheeled nozzle 11 connected to a wheeled canister 12 by a flexible suction hose 13 which includes electrical conductors. One end of the suction hose 13 is connected by suitable connection means including a conventional handle, not shown, to a tubular wand 14 connected to the nozzle, and the opposite end 15 of the electrical hose is connected to a suction inlet 16 of the canister 12 by means of the swivel connector of the present invention generally designated 17.

As further shown in FIG. 3, the structure includes an electrical power plug 21 mounted to the swivel connector and connected by a pigtail 22 to the swivel connector to electrical power conducting means 23 including terminals embodied in the swivel connector connected in turn, to the electrical conductors of hose 13.

More specifically, swivel connector 17 includes a first portion defined by an angled inner swivel tube 24 having one end 25 fixedly received in a hose cuff 26. The opposite end 27 of the swivel tube is received in a swivel housing 28 adapted to be inserted into the opening 29 of the suction inlet 16.

The swivel connector further includes an angled link plug 30, which is fixedly mounted to the midportion of the angled inner swivel tube, as shown in FIG. 3. Power plug 21 is removably secured in a plug frame 31 carried by the swivel housing 28. Pigtail 22 is connected at one end 32 through a connecting portion 33 to the power plug 21, and is connected at the other end 34 to a female electrical connector 35 molded into the link plug 30, as seen in FIG. 3. Electrical power conducting means 23 defines male terminals 36 which plug into the female connector 35 when hose cuff 26 is urged onto the end 25 of swivel tube 24.

Power plug 21 is provided with a resilient interlock element 37, which springs outward slightly so that it is received in an opening 38 formed in the plug frame 31 for releasably locking the power plug in the plug frame and, thus, to the swivel housing 28, with the male terminals 18*a* thereof projecting from the plug frame for facilitated reception in the power source connector receptacle 18 as an incident of insertion of the swivel housing portion 28 of the swivel connector into the suction inlet opening 29, as illustrated in FIG. 2.

As shown in FIG. 4, the lower end of the power plug defines an inwardly projecting lip 39 which is slidably received in a segmentally annular groove 40 extending coaxially partially about end 27 of swivel tube 25, as seen in FIG. 3. The opposite ends of the groove 40 define stops 41 which limit the amount of swiveling of the swivel tube relative to the swivel housing, which, as indicated above, is locked in the suction inlet 16 in the installed arrangement of the hose end. This prevents strain from being applied to the pigtail 22, thereby assuring long troublefree life of the connector.

As will be obvious to those skilled in the art, suitable selection of the stops may be coordinated with the preselected length of the pigtail so as to provide any desired amount of permitted swiveling up to approximately 360°, or up to a maximum of approximately 180° clockwise and counterclockwise from a center position. In the absence of the stops or stop ends 41 of the groove 40, the swivel tube may be swung up to the limit permitted by the length of the pigtail. In the centered position of FIG. 1, the swivel tube is angled directly forwardly from the canister 12. As shown in FIGS. 5 and 6, the swivel tube may be angled reversely from the centered position. As shown in FIG. 4, the swivel stops 41 are disposed approximately 125° oppositely from the centered position and, thus, a total swivel angle of approximately 250° is provided in the illustrated embodiment. In FIGS. 5 and 6, the opposite swivel positions approximately 90° from the centered position of FIG. 4 are illustrated.

In the illustrated embodiment, catch 20 defines a stop shoulder 42 cooperating with an inturned distal end 43 of the latch 19 to retain the swivel connector in the suction inlet opening 29 releasably in the connected arrangement of the apparatus. As further illustrated in FIG. 3, the catch 20 includes an outer abutment portion 44 which may be engaged automatically by the user's hands when grasping the swivel housing 28 for removing the swivel housing from the suction inlet opening 29 in disconnecting the hose from the canister as upon completion of a vacuum cleaning operation. Thus, the interlock means is automatically arranged for disengagement as an incident of removal of the hose end from the canister, further facilitating use of the apparatus.

Figure 9:
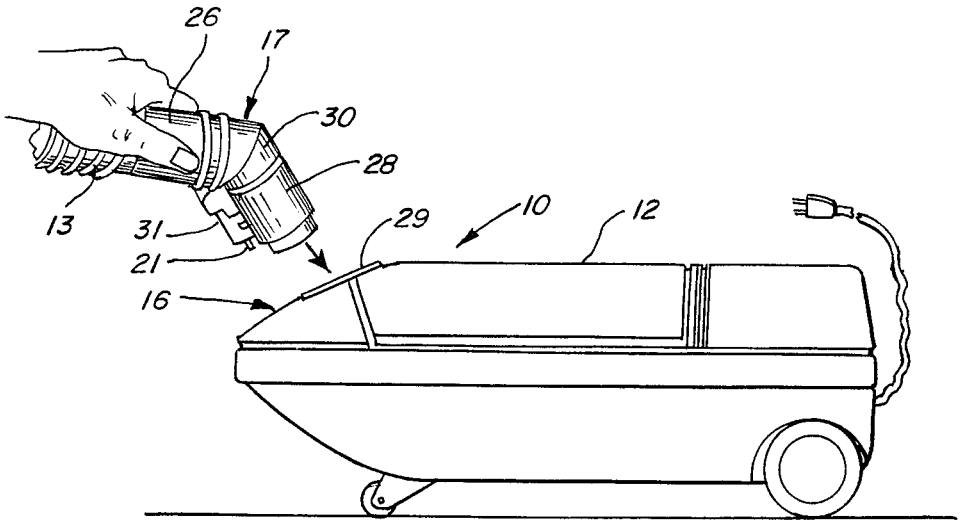
FIG. 9 is a fragmentary side elevation of the canister vacuum cleaner of FIG. 1 prior to connection of the hose and swivel connector embodying the invention.

As further illustrated in FIG. 3, the catch 20 includes an angled guide portion 45 which engages the catch 43 slidably as the swivel housing portion 28 of the swivel connector is inserted into the suction inlet opening 29 so as to automatically effect the interlocked retention of the swivel connector to the canister as an incident of the user inserting the swivel connector into the suction inlet opening 29 in connecting the hose to the canister. Thus, in effecting such insertion, the user may grasp the hose cuff 26, as illustrated in FIGS. 2 and 9, with the insertion of the swivel housing portion 28 of the swivel connector 17 into the suction inlet opening 29, automatically effecting the electrical connection of power plug 21 to the power source connector 18 and the interlocked retention of the swivel connector to the canister, as discussed above. The angled arrangement of the hose cuff 26 to the swivel connector portion 28, as shown in FIG. 2, further facilitates the automatic connection of the hose end to the canister by the user.

In the illustrated embodiment, the different components of the swivel connector 17 may be formed of molded synthetic resin. Thus, pigtail end 34 may be molded integrally with the link plug 30, and catch 20 may be molded integrally with the plug frame 31, which, in turn, may be molded integrally with the swivel housing 28.

The swivel connector of the present invention which is mounted on the end of the electrical hose for connection to the suction inlet of the canister as shown in FIGS. 2 and 9 is extremely simple and economical of construction, while yet providing facilitated connection and disconnection by the user relative to the canister 12, with automatic electrical connection and interlocking of the swivel connector to the canister being effected as an incident of the insertion of the swivel housing portion of the swivel connector into the suction inlet opening of the canister. The electrical connection between the hose conductors 23 and the power source 18 in the canister is automatically effected as an incident of manipulation of the swivel connector in connecting and disconnecting the hose connection to the suction inlet.

The foregoing disclosure of specific embodiment is illustrative of the broad inventive concepts comprehended by the invention.

I claim:

1. In a vacuum cleaner having a canister housing defining a suction inlet and an electrical power connector adjacent said inlet, and a hose for conducting dirt-laden air to said suction inlet and provided with electrical power conducting means, the improvement comprising:

a swivel connector having a first portion secured to said hose end, and a second portion adapted to be removably secured to said housing in said suction inlet, said first portion being swivelly connected to said second portion;

an electrical power plug mounted to said swivel connector second portion;

catch means associated with said housing adjacent said suction inlet;

a flexible electrically conductive pigtail having a first end electrically connected to said power plug and a second end electrically connected to said electrical power conducting means of said hose, said pigtail having a length preselected to permit swiveling of said swivel connector first portion relative to said second portion up to a maximum preselected angle;

latch means on said swivel connector disposed to releasably engage said catch means when the swivel connector second portion is received in said suction inlet to connect said hose end to said suction inlet, said power plug being disposed to have electrically connected association with said electrical power connector as an incident of said swivel connector second portion being so received in said suction inlet.

2. The vacuum cleaner structure of claim 1 wherein said swivel connector second portion defines a manually graspable means for use in urging said swivel connector into and from said suction inlet, and said vacuum cleaner structure further includes latch means associated with said housing adjacent said suction inlet opening and complementary catch means associated with said swivel connector second portion for releasable interlocking engagement with said latch means as an incident of insertion of said swivel connector second portion into said suction inlet, said catch means being disposed to be manually displaced to disengage it from said latch means as an incident of the swivel connector second portion being grasped to remove it from said suction inlet.

3. The vacuum cleaner structure of claim 1 wherein said swivel connector second portion defines a manually graspable means for use in urging said swivel connector into and from said suction inlet, and said vacuum cleaner structure further includes latch means associated with said housing adjacent said suction inlet opening and complementary catch means associated with said swivel connector second portion for releasable interlocking engagement with said latch means as an incident of insertion of said swivel connector second portion into said suction inlet, said catch means being disposed to be manually displaced to disengage it from said latch means as an incident of the swivel connector second portion being grasped to remove it from said suction inlet, and cooperating means on said latch means and catch means for guiding said catch means into interlocking association with said latch means as an incident of the insertion of said swivel connector second portion into said suction inlet.

4. The vacuum cleaner structure of claim 1 wherein said swivel connector second portion defines a manually graspable means for use in urging said swivel connector into and from said suction inlet, and said vacuum cleaner structure further includes latch means associated with said housing adjacent said suction inlet opening and complementary catch means associated with said swivel connector second portion for releasable interlocking engagement with said latch means as an incident of insection of said swivel connector second portion into said suction inlet, said catch means being disposed to be manually displaced to disengage it from said latch means as an incident of the swivel connector second portion being grasped to remove it from said suction inlet, said catch means being formed integrally with said swivel connector second portion.

5. The vacuum cleaner structure of claim 1 wherein said swivel connector second portion defines a manually graspable means for use in urging said swivel connector into and from said suction inlet, and said vacuum cleaner structure further includes latch means associated with said housing adjacent said suction inlet opening and complementary catch means associated with said swivel connector second portion for releasable interlocking engagement with said latch means as an incident of insertion of said swivel connector second portion into said suction inlet, said catch means being disposed to be manually displaced to disengage it from said latch means as an incident of the swivel connector second portion being grasped to remove it from said suction inlet, said swivel connector second portion having a power plug housing thereon for mounting said power plug thereto, said catch means being formed integrally with said power plug housing.

6. The vacuum cleaner structure of claim 1 further including cooperating stop means on said swivel connector second portion for limiting the amount of swiveling permitted between said first and second portions.

7. The vacuum cleaner structure of claim 1 further including cooperating stop means on said swivel connector second portion for limiting the amount of swiveling permitted between said first and second portions to a maximum of approximately 360°.

8. The vacuum cleaner structure of claim 1 further including cooperating stop means on said swivel connector second portion for limiting the amount of swiveling permitted between said first and second portions to a maximum of approximately 180° clockwise and counterclockwise from a center position.

9. The vacuum cleaner structure of claim 1 wherein said second end of the pigtail is formed intergrally with said swivel connector first portion.

10. The vacuum cleaner structure of claim 1 wherein said first end of the pigtail is formed integrally with said power plug.

11. The vacuum cleaner structure of claim 1 wherein said pigtail extends arcuately from said power plug about said swivel connector first portion at the position of extreme permitted angular displacement of said first portion relative to said second portion.

12. The vacuum cleaner structure of claim 1 wherein said pigtail includes at least two electrical conductors.

13. The vacuum cleaner structure of claim 1 wherein said swivel connector first portion comprises an inner swivel tube having a first tubular end adapted to be removably secured in the hose end and a second tubular end extending at an angle from said first end and being swivelly received in said swivel connector second portion.

14. The vacuum cleaner structure of claim 1 wherein said swivel connector first portion comprises an inner swivel tube having a first tubular end adapted to be removably secured in the hose end and a second tubular end extending at an angle from said first end and being swivelly received in said swivel connector second portion, said first portion further including an annular link plug extending about an angled connection of said first tubular end and said second tubular end, said pigtail second end being connected to said link plug for electrical connector therethrough to said electrical power conducting means of said hose.

15. In a vacuum cleaner structure having a suction hose and a canister defining a suction inlet arranged for connection thereof to one end of said hose to provide a swivelable suction connection therebetween, electrical power source means on said canister, and electrical power conducting means on said base, the improvement comprising electrically conductive means for electrically connecting said electrical power conducting means on the hose to said electrical power conducting means on the canister as an incident of connection of said hose end to said suction inlet, said electrically conductive means comprising a flexible pigtail permitting reciprocable swiveling of said hose end relative to said canister up to a preselected maximum amount from a center disposition.

16. The vacuum cleaner structure of claim 15 wherein said pigtail has a length preselected to permit approximately 150° maximum reciprocable swiveling of said hose end relative to said canister.

17. The vacuum cleaner structure of claim 15 wherein said electrical power source means is disposed in said suction inlet.

18. In a vacuum cleaner structure having a suction hose and a canister defining a suction inlet arranged for connection thereof to one end of said hose to provide a swivelable suction connection therebetween, electrical power source means on said canister, and electrical power conducting means on said base, the improvement comprising:

cooperating interlock means associated with said hose end and canister respectively for releasably locking the hose end to the suction inlet; and electrically conductive means for electrically connecting said electrical power conducting means on the hose to said electrical power conducting means on the canister as an incident of connection of said hose end to said suction inlet, said electrically conductive means comprising a flexible pigtail permitting reciprocable swiveling of said hose end relative to said canister up to a preselected maximum amount from a center disposition.

19. The vacuum cleaner structure of claim 18 wherein said interlock means defines means for effecting interlocked engagement therebetween as an incident of connection of said hose end to said suction inlet.

20. The vacuum cleaner structure of claim 18 wherein said interlock means associated with said canister is disposed in said suction inlet.

* * * * *